US011345449B2

(12) United States Patent
Sommerlatt

(10) Patent No.: US 11,345,449 B2
(45) Date of Patent: May 31, 2022

(54) HYDROFOIL TO BE FASTENED TO A WATERSPORTS BOARD

(71) Applicant: NORTH Kiteboarding Australasia, Limited, Auckland (NZ)

(72) Inventor: Joern-Ulrich Sommerlatt, Auckland (NZ)

(73) Assignee: NORTH KITEBOARDING AUSTRALASIA, LIMITED, Auckland (NZ)

( * ) Notice: Subject to any disclaimer, the term of this patent is extended or adjusted under 35 U.S.C. 154(b) by 0 days.

(21) Appl. No.: 16/911,045

(22) Filed: Jun. 24, 2020

(65) Prior Publication Data

US 2020/0407026 A1 Dec. 31, 2020

(30) Foreign Application Priority Data

Jun. 25, 2019 (DE) ..... 20 2019 103 496.3

(51) Int. Cl.

| | |
|---|---|
| ***B63B 32/66*** | (2020.01) |
| ***B63B 32/40*** | (2020.01) |
| ***B63B 1/24*** | (2020.01) |
| ***B63B 34/40*** | (2020.01) |

(52) U.S. Cl.

CPC ..... *B63B 32/66* (2020.02); *B63B 1/242* (2013.01); *B63B 32/40* (2020.02); *B63B 34/40* (2020.02)

(58) Field of Classification Search

CPC ..... B63B 32/00; B63B 32/20; B63B 32/40; B63B 32/60; B63B 32/66; B63B 32/70; B63B 35/00; B63B 35/79; B63B 35/85; B63B 1/00; B63B 1/24; B63B 1/242; B63B 1/26; B63B 34/00; B63B 32/77; B63B 34/40

USPC ..... 114/274; 441/65, 74, 79

See application file for complete search history.

(56) References Cited

U.S. PATENT DOCUMENTS

| | | | | |
|---|---|---|---|---|
| 7,980,191 | B2 * | 7/2011 | Murphy | B63B 32/20 114/274 |
| 9,085,343 | B2 * | 7/2015 | Modica | B63B 1/24 |
| 9,278,739 | B2 * | 3/2016 | Salles | B63B 32/60 |
| 9,586,651 | B2 * | 3/2017 | Modica | B63B 1/24 |
| 9,896,158 | B2 * | 2/2018 | Modica | B63B 32/60 |
| 10,358,193 | B2 * | 7/2019 | Lobisser | B63B 1/26 |
| 2005/0266746 | A1 | 12/2005 | Murphy | |

(Continued)

FOREIGN PATENT DOCUMENTS

| | | |
|---|---|---|
| EP | 2939917 B1 | 3/2017 |
| EP | 3461734 A1 | 4/2019 |

*Primary Examiner* — Lars A Olson

(74) *Attorney, Agent, or Firm* — McGlew and Tuttle, P.C.

(57) ABSTRACT

A hydrofoil (1) includes a mast (2), with an incoming flow edge (3), a discharge edge (4), lateral surfaces (5) and an upper mast end (6) with a holder (7) to be fastened to a watersports board. A fuselage (8) has front (10) and rear wings (11) are arranged on opposite sides. The mast and the fuselage are configured as separate components and are connected to one another via a screw connection (12). An adapter (13) is connected to the mast and to the fuselage and is arranged in a recess (14) of the fuselage. A positive locking is established between an adapter outer surface (15) and the recess of the fuselage. An adapter mount (16) receives a lower mast end (9). A positive locking is formed between the mast and the adapter such that the lower mast end is arranged within the fuselage.

21 Claims, 2 Drawing Sheets

(56) References Cited

U.S. PATENT DOCUMENTS

| | | | |
|---|---|---|---|
| 2015/0017850 | A1 | 1/2015 | Modica et al. |
| 2017/0355429 | A1 | 12/2017 | Lobisser |

* cited by examiner

HYDROFOIL TO BE FASTENED TO A WATERSPORTS BOARD

CROSS REFERENCE TO RELATED APPLICATIONS

This application claims the benefit of priority under 35 U.S.C. § 119 of German Application 20 2019 103 496.3, filed Jun. 25, 2019, the entire contents of which are incorporated herein by reference.

TECHNICAL FIELD

The present invention pertains to a hydrofoil to be fastened to a watersports board with a mast, which has an incoming flow edge and a discharge edge as well as lateral surfaces connecting these and at the upper mast end of which a holder is arranged, which said holder can be indirectly fastened to the watersports board. Further, the hydrofoil has a fuselage, which is fastened at the lower mast end and whose longitudinal axis is arranged at least nearly in a plane defined by the incoming flow edge and the discharge edge of the mast and at which respective front and rear wings are provided on opposite sides of the mast. The mast and the fuselage are configured as separate components and are connected to one another by means of a screw connection.

TECHNICAL BACKGROUND

A hydrofoil is, in general, a hydrofoil that is mounted under the hull of a boat in order to lift the boat during the travel during increasing speed based on the dynamic buoyancy at the hydrofoil located under water. Since only a small part is located under the surface of the water after lifting the hull of the boat, the displacement and the frictional resistance are markedly reduced, so that higher speeds can be reached.

Such hydrofoils, which are mounted under the board, the so-called foilboard, are also used in kitesurfing. The board is moved upward at a sufficiently high speed based on the dynamic lifting surface in this case as well, so that only the hydrofoil is in contact with the water at a sufficiently high speed and correspondingly high traveling speeds are reached. It is likewise advantageous that considerable traveling speeds can be reached at times by means of the hydrofoil described even at low wind forces and/or with the use of comparatively small sails or stunt kite.

The prior-art hydrofoils have a mast dipping into the water in the vertical direction, at the lower end of which a fuselage is fastened, which said fuselage forms the hull of the hydrofoil and at which respective rear and front wings arranged at right angles to the direction of travel are arranged. Such hydrofoils are configured as one-piece components or as an assembly unit, in which at least some of the aforementioned components are integrated.

A hydrofoil of this class, which can be fastened to the underside of a foilboard used for kitesurfing, is known in this connection from EP 3 461 734 A1. The hydrofoil described has, in turn, a mast, which can be fastened via a fastening plate on the underside of a board and which has, at its end facing away from the fastening plate, a fuselage, which has a front wing and a rear wing. It is essential for the technical solution described that the fastening plate is connected to the mast by means of a bonded connection. The fastening plate bonded to the mast can be fastened on the underside of a foilboard either by means of screws or by insertion into a recess provided for this purpose on the underside of a foilboard.

Another hydrofoil of a special configuration is known from EP 2 939 917 B1. The hydrofoil described in this document is characterized especially in that it is composed of different components. The mast is connected here rigidly at its end facing away from the foilboard to a central piece of the fuselage, and the mast and the central piece have a one-piece configuration. A front part with a front wing as well as also a rear part with a rear wing may be fastened on both sides of the central piece. Connection elements are provided for fastening the front part and the rear part of the fuselage at the central piece thereof, so that the front part and the rear part of the fuselage can be inserted into the central piece and locked in the use position by means of suitable connectors.

Since comparatively strong dynamic forces act at times on the hydrofoils, reliable transmission of corresponding forces and torques between the individual components of a hydrofoil and the appropriate introduction thereof into the board are of considerable significance. It should be taken into consideration in this connection that a deflection of the forces being introduced by at least nearly 90° takes place at the connection points of the individual components, i.e., for example, at the transition from the front and rear wings to the fuselage and especially from the fuselage to the mast. It follows from this that considerable torques develop at times at the corresponding connection points, and this may lead to problems concerning the necessary strength especially in the connection area between the fuselage and the mast. The configuration and the design embodiment of the connection area between the fuselage and the mast therefore represent, as a rule, a considerable challenge. Further, a problem arises in some cases when different masts and fuselages shall be combined with one another, so that the mast and the fuselage are connected detachably to one another. Screws or bolts are usually used to connect the mast to the fuselage, and these screws or bolts will then at times have to withstand considerable forces and torques. Even if the screws are not torn off, even a comparatively slight stretching or bending of the screws may represent a rather substantial problem during the removal or mounting of the fuselage at the mast. Corrosion problems may also arise in the connection areas, especially as soon as different metals abut against one another and there is contact with saline sea water at the same time.

SUMMARY

Starting from the hydrofoil known from the state of the art as well as from the above-described problems, the basic object of the present invention is to provide a hydrofoil, which has a fuselage that can be detachably fastened to the mast, wherein the connection area between the mast and the fuselage shall be configured such that forces and torques that occur will be reliably transmitted, without a considerable stress of the screws to be feared in this area. A connection should be provided here between the mast and the fuselage, in which a transmission of forces and torques takes place over comparatively large areas, so that the development of peak loads in the connection area between the mast and the fuselage is ruled out to a great extent. Nevertheless, replacement and the removal as well as the mounting of the fuselage at the mast shall be possible in a comparatively simple manner.

The components necessary for establishing the connection between the mast and the fuselage shall also be able to be manufactured in a simple manner and likewise in as cost-effective a manner as possible. Another aspect of the present invention pertains to the fatigue strength of a connection between the mast and the fuselage. In particular, the technical solution to be proposed should not only withstand frequently occurring loads, but also at least minimize, moreover, the wear of the components involved, especially corrosion phenomena occurring on the basis of the contact with sea water.

The present invention pertains to a hydrofoil to be fastened to a watersports board with a mast, which has an incoming flow edge and a discharge edge as well as lateral surfaces connecting these and at the upper mast end of which a holder that can be fastened at least indirectly to the watersports board is arranged, with a fuselage, which is fastened to the lower mast end such that it can be nondestructively detached by means of a screw connection and the central longitudinal axis of which is arranged at least nearly in a plane in which the incoming flow edge and the discharge edge of the mast are located, and with respective front and rear wings arranged at the fuselage on opposite sides of the mast. The present invention is characterized in that the mast is configured as an extruded section and an adapter is provided, via which the separate components, namely, the mast and the fuselage, are connected to one another, by the adapter being arranged in a recess of the fuselage, forming a positive-locking connection between the outer surface of the adapter and the recess of the fuselage, and having a mount, into which the lower mast end is inserted, forming a positive-locking connection between the mast and the adapter, such that the end of the mast, which end faces the fuselage, is arranged within the fuselage. It is thus essential for the technical solution according to the present invention that an adapter, which connects the mast and the fuselage, is configured as a separate component and via which forces and torques are transmitted between the fuselage and the mast, is provided between the mast and the fuselage. The adapter is located in a recess of the fuselage, and a positive-locking connection is established between the adapter and the fuselage, so that forces and/or torques are transmitted between the fuselage and the adapter over a comparatively large outer area of the adapter, which area is in contact with a corresponding opposing contour of the recess in the fuselage. Furthermore, the mast with its lower mast end is inserted into a corresponding adapter mount, so that a positive-locking connection is likewise achieved between the mast and the adapter. It is highly advantageous in this connection that the mast is inserted into the adapter such that the end of the mast, which end faces the fuselage, is arranged within the fuselage. A contact surface, via which forces and/or torques are transmitted between the adapter and the mast, is, in turn, formed between an outer surface of the lower mast end and the adapter mount. It is advantageously ensured by a corresponding adapter component, which is in contact with both the fuselage and the outer wall of the lower mast end in a positive-locking manner, that a transmission of forces takes place in the connection area between the mast and the fuselage over a comparatively large area, so that stresses, especially in screws connecting the fuselage to the mast, are minimized. The adapter is advantageously configured such that the adapter also protrudes into the mast at least in some areas and an at least partially positive-locking connection is, in turn, established here between the adapter and an inner surface of the at least partially hollow mast.

A bonded connection is advantageously present in at least some areas between the adapter and the mast. It is conceivable in this connection, in particular, that a bonded connection is provided between at least one partial area of the adapter, especially of a suitable connection structure of the adapter, which partial area protrudes into the mast, and an inner surface of the mast. The adapter can thus be connected to the mast permanently in a comparatively simple and reliable manner and in a correct position. A reliable connection of the adapter to the mast is established in this manner within the mast and it is ensured at the same time that the adapter is always located in the position advantageous for the transmission of forces within the mast.

Provisions are made in another special embodiment for the adapter to have a plastic. It is conceivable in this connection that the plastic used is a plastic reinforced with glass fibers or carbon fibers. The use of an adapter that has plastic at least partially offers the advantage that a contact between two metals, especially two different metals, will not develop in the connection area between the mast and the fuselage outside the area used for the screw connection. An adapter that has plastic ensures here that different metals will not come into contact either between the mast and the adapter or between the fuselage and the adapter or even between the fuselage and the mast. Metal corrosion or contact corrosion between corresponding metals in the connection area between the mast and the fuselage is reliably prevented from occurring in this manner. There is generally a risk especially in the presence of salt water that a rather substantial contact corrosion will occur between different metals. If the adapter has a plastic material, there is a metallic connection between the mast and the fuselage only in the area of the screws. In order additionally to prevent a contact of the screw connection and hence of the area between screws and fuselage and/or between screws and the mast with salt water, the screw connection is preferably sealed against the surrounding area and hence during the use of the hydrofoil against sea water by means of anti-seize paste.

The adapter is preferably manufactured by plastic injection molding. The needed shape of the adapter, especially the adapter mount as well as a connection structure protruding into the interior of the mast after the mounting, can be manufactured especially effectively in this manner.

It is also conceivable, in general, that the mast, the fuselage and/or the adapter contain aluminum, manganese or a fiber-containing plastic.

Provisions are thus made according to a special variant of the present invention for the mast to be configured as an extruded aluminum section. It is likewise conceivable that the mast, the fuselage and/or the adapter have, in at least some areas, a protective coating which reliably prevents a contact of the respective material used for the component on the surface with the surrounding area, above all with salt water. Such a protective coating is preferably configured as an oxide coating prepared by anodic oxidation.

In a special embodiment of the present invention, the adapter has a connection structure, which protrudes into the mast and is in contact in at least some sections with an inner wall of the mast. It is advantageous in reference to the connection structure of the adapter, which protrudes into the interior of the mast and establishes a positive-locking connection in the interior of the mast between the adapter and an inner surface of the mast, if this connection structure has a cuboid and/or cubic structural element, which is in contact in at least some areas within the mast with the inner wall of the mast. As an alternative or in addition, it is conceivable that at least one circular cylindrical or oval cylindrical structural element is provided, which is in contact with the inner wall of the mast in at least some areas within the mast.

It is always essential that the connection structure of the adapter establishes a positive-locking connection in the interior of the mast between the adapter and the mast.

Furthermore, it is generally conceivable that the connection structure of the adapter has at least two structural elements arranged in a row, by which a positive-locking connection is established between the adapter and the mast at least in some areas within the mast. The structural elements mesh according to this embodiment in the manner of teeth with a corresponding opposing contour in the interior of the mast.

In a hydrofoil of this class, the mast and the fuselage are connected to one another via a screw connection, which has one screw or a plurality of screws. The screws are screwed into suitable internal threads provided in the interior of the mast. Hollow sections extending in the longitudinal direction of the mast, especially tubular hollow sections, in which the internal thread is located, are preferably provided in the interior of the mast. The sections are used in part at the same time to reinforce the mast.

In a special variant, the screw connection has at least one flat head screw with hexagon socket and a complementary internal thread arranged in the interior of the mast, into which the flat head screw can be screwed. In order to reliably protect the screw connection during the operation of a hydrofoil from penetrating salt water and the contact corrosion with other metals, which is associated therewith, an anti-seize paste is advantageously introduced into the area of the screw connection. As an alternative or in addition, it is conceivable in this connection that an electrically non-conducting element or an electrically non-conducting layer is arranged between a screw of the screw connection and the fuselage in order to prevent the contact corrosion, for example, between a screw made of stainless steel and a mast made of aluminum.

According to another special embodiment of the present invention, the rear wing is bent at both of its ends upwards in at least some areas about the area facing the mast. Furthermore, it is conceivable that a fin, which is likewise fastened to the fuselage or is formed in one piece with this, is arranged in the rear area of the fuselage. It is especially preferred if the fin is integrated into the rear wing. It is also advantageous if the fin is directed upwards and projects beyond the surface of the fuselage facing the mast.

The hydrofoil configured according to the present invention can be used, in principle, for each board that is intended for moving in the water or on the surface of the water. A hydrofoil that is configured according to at least one of the above-described embodiments is preferably used for wakeboarding, surfing and/or kitesurfing, the hydrofoil being fastened on the underside of the watersports board, also called board, that is needed to engage in the respective type of water sport. The fastening is carried out here via a holding element provided at the upper end of the mast, the mast head, which makes it possible to screw the hydrofoil to the watersports board and/or to fasten the hydrofoil in a suitably configured mount of the watersports board.

The present invention will be explained in more detail below without limitation of the general inventive idea on the basis of special embodiments and with reference to the figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
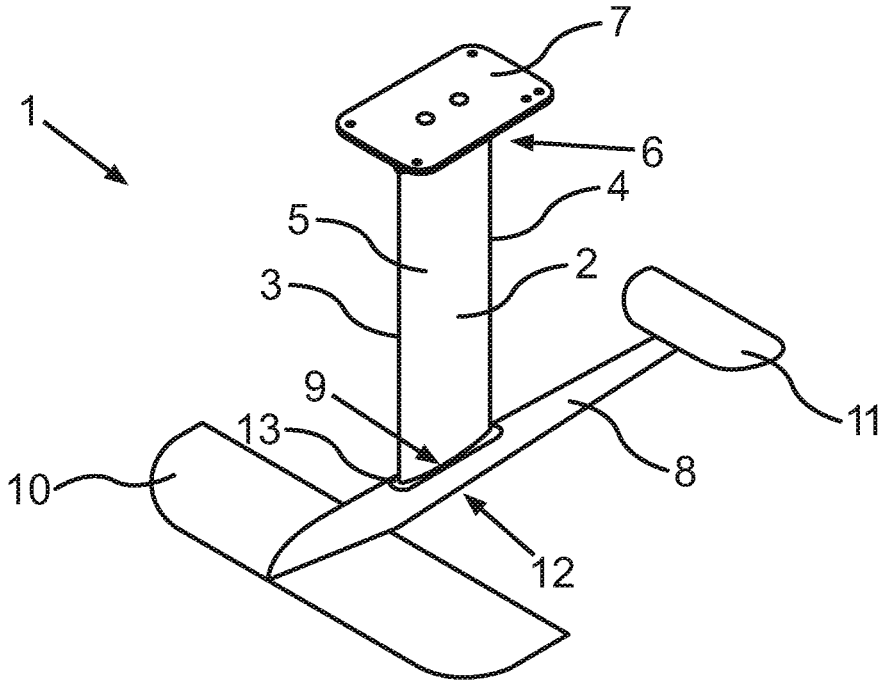
FIG. 1 is a perspective view of a hydrofoil according to the present invention to be fastened to a foilboard for kitesurfing.

Referring to the drawings, FIG. 1 shows a hydrofoil 1 configured according to the present invention in a perspective view. The hydrofoil 1 has a holding element 7, which is arranged at the upper end 6 of a mast 2 and is used to fasten the hydrofoil on the underside of a kiteboard or foilboard. The holding element 5 has in the outer area four holes, through which the screws can be passed and screwed in suitable threads in the board.

In the use position of the hydrofoil 1, the mast 2 extends, starting from the holding element 7, in the vertical direction in the water. A fuselage 8 is arranged at the end 9 of the mast 2, the mast foot, which end is located opposite the upper end 6, and is fastened to the mast 2 by means of two screws, which are not shown in this view. The longitudinal direction of the fuselage 8 is directed in the direction of travel or in the direction of movement during the use. A front wing 10, also called frontwing, is fastened at the fuselage 8 at the front end of the fuselage 8. A rear wing 11 is arranged at the rear end of the fuselage 8.

Such a hydrofoil ensures that a watersports board fastened to the hydrofoil is moved upward during travel on or through the water based on hydrodynamic forces and is thus lifted off from the surface of the water. Based on this movement, the area that is in contact with the water is considerably reduced on the basis of this movement, so that considerable traveling speeds can be reached at times with the watersports board even at low wind forces and/or with comparatively small sail or stunt kite areas.

The technical feature of the hydrofoil 1, which is configured according to the present invention and is shown in FIG. 1, which technical feature is essential for the present invention, can be seen in the fact that the mast 2 and the fuselage 8 are configured as separate components and are connected to one another via an adapter 13, which is likewise a separate component. The adapter 13 is arranged here within a recess 14 in the fuselage 8, and a positive-locking connection is established between the recess 14 and the outer surface 15 of the adapter 13. Furthermore, the mast 2 is inserted into an adapter mount 16 of the adapter 13 such that the lower mast end 9 is located within the fuselage 8. Forces that are transmitted between the fuselage 8 and the mast 2 via the adapter 13 are thus transmitted via the positive-locking connections between the fuselage 8 and the adapter 13, on the one hand, and between the adapter 13 and the lower mast end 9, on the other hand. Comparatively large areas are thus obtained for the transmission of the forces and torques developing during the operation of the hydrofoil 1, and punctiform peak loads or stresses are ruled out at least to a great extent in the connection area between the fuselage 8 and the mast 2. Even though this cannot be seen in this view, the adapter 13 has a connection structure 17, which protrudes into the interior of the hollow mast 2 configured as an extruded aluminum section, and a positive-locking connection is in turn created between the connection structure 17 of the adapter 13 and the inner wall 18 of the mast 2. The mast 2 is thus held securely within the adapter 13 and contact areas are present both between the outer surface 21 of the mast 2 and the adapter 13 and also between the inner wall 18 of the mast 2 and the adapter 13.

The mast 2 and the fuselage 8 are manufactured from aluminum, while the adapter 13 is an injection-molded plastic part in the exemplary embodiment shown in FIG. 1. The adapter 13, which is configured as an injection-molded plastic part and has a connection structure 17 protruding into the mast 2, is bonded via the connection structure 17 protruding into the interior of the mast 2 to the inner wall 18 of the mast 2. A permanent and reliable connection is established in this manner between the adapter 13 and the mast 2, so that the mast 2 can be separated together with the adapter 13 from the fuselage. The presence of an adapter 13, which is made of plastic, also has the advantage that there will be no direct contact between the mast 2 and the fuselage 8. Any possible damage to the surfaces during the assembly or disassembly can thus be avoided. It is likewise ensured that contact corrosion will not develop between the mast 2 and the fuselage 8, especially if these consist of different metals. This is significant, in particular, because the hydrofoil 1 shown is usually used in salt water, which markedly increases the risk of a contact corrosion between different metals.

Figure 2:
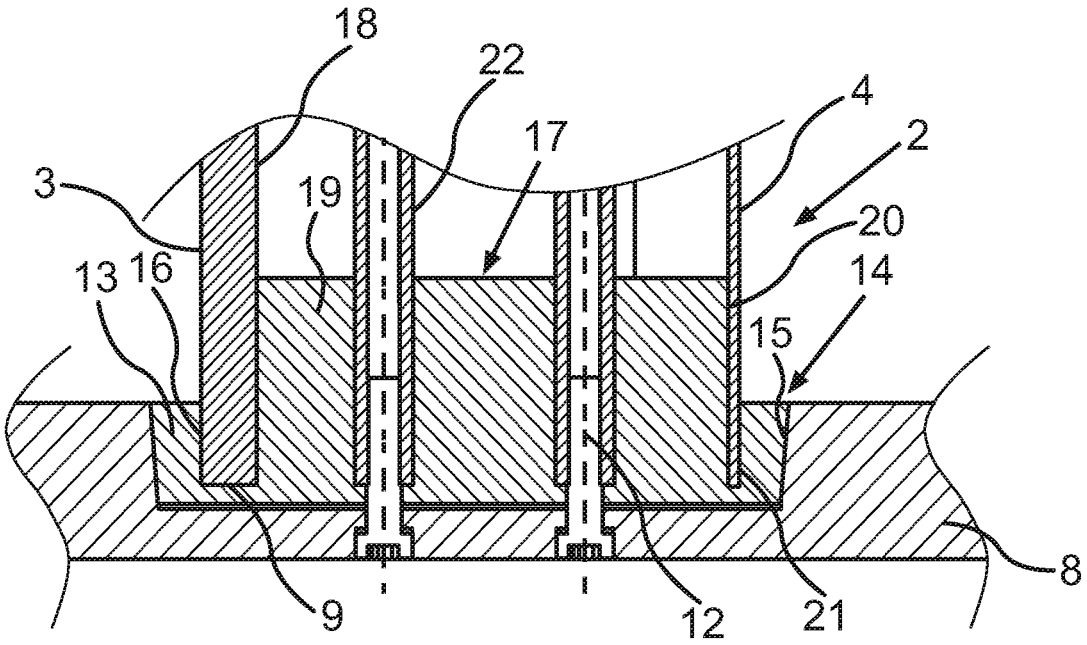
FIG. 2 is a detail longitudinal sectional view through the area between the fuselage and the mast.

FIG. 2 shows the detail of a sectional view in the longitudinal direction of the connection area between the fuselage 8 and the mast 2 of a hydrofoil 1 configured according to the present invention. The mast 2 is configured here as an extruded aluminum section and is partially hollow inside, and the mast 2 has, in its interior, two tubular struts 22, which extend in the longitudinal direction of the mast 2 and have an internal thread each, for establishing a screw connection 12.

Flat head screws with internal hexagon are screwed into these internal threads to fasten the fuselage 8 to the mast 2.

It is essential for the present invention that the mast 2 is inserted into an adapter mount 16, and the lower end 9 of the mast is located within a recess of the fuselage 8 and hence within the fuselage 8. A transmission of forces between the fuselage 8 and the mast 2 consequently takes place based on the positive-locking connection in this area via a comparatively large contact surface between the adapter 13 and the fuselage 8. The adapter 13 also has a connection structure 17, which protrudes into the interior of the mast 2 and establishes a positive-locking connection there to the inner wall 18 of the mast 2, and a positive-locking connection is formed both between the connection structure 17 and the inner wall 18 of the mast 2 and between the connection structure 17 of the mast and the struts 22 extending vertically in the interior of the mast 2.

The adapter 13 is arranged in a recess 14 of the fuselage 8 and a positive locking is obtained between the recess 14 and the outer surfaces of the adapter 13. The outer surfaces of the adapter 13 are beveled such that the adapter 13 has its smallest diameter at the lower end facing the fuselage 8, while the diameter increases continuously in the direction of the end of the adapter 13 facing the upper side of the fuselage 8. The adapter 13 is made of plastic, so that there is no direct contact between the mast 2 and the fuselage 8. Both the lower end 9 of the mast 2 and the recess 14 of the fuselage 8 are also reliably sealed by the adapter 13 against the surrounding area, above all against the sea water. It is ensured in this manner that no water can enter an area in which the screws of the screw connection 12 exit from the fuselage 8 in the interior of the fuselage 8. Further, the screws are sealed by means of an anti-seize paste against the surrounding area, so that no sea water can enter the thread area and hence a contact area of different metals via the area of the screw heads, either. This is especially significant because screws made of stainless steel are usually used for the screw connection, while an aluminum-containing material is preferably used for the fuselage 8 and/or the mast 2.

Figure 3:
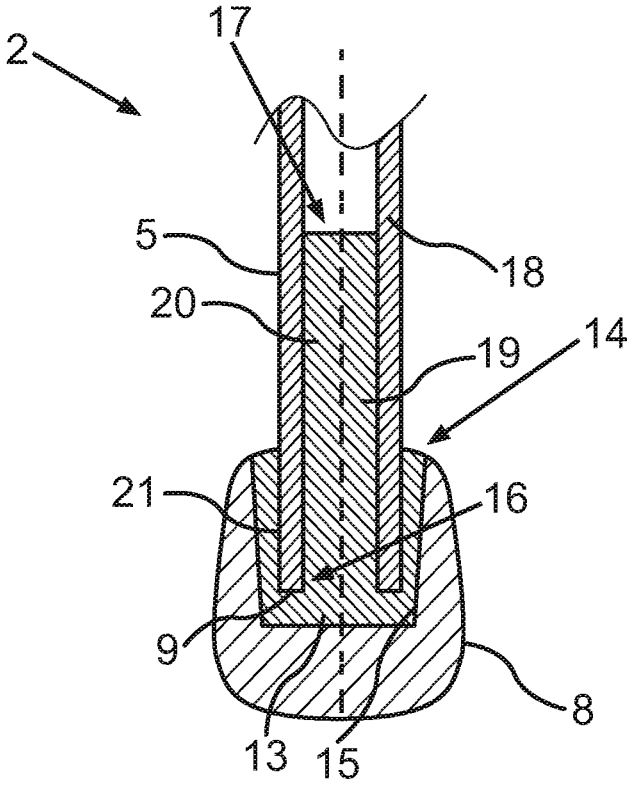
FIG. 3 is a detail cross sectional view through the connection area between the fuselage and the mast.

FIG. 3 additionally shows a sectional view of the connection area between the fuselage 8 and the mast 2, the section extending in this case in the transverse direction of the fuselage 8. It can again be seen clearly that a positive locking is established by means of the adapter 13 both between the fuselage 8 and the adapter 13 and between the adapter 13 and the mast 2. The lower end 9 of the mast 2, which is located within the adapter mount 16 of the adapter 13, is thus held securely within the recess 14 of the fuselage 8, so that forces and/or torques are transmitted directly within the fuselage 8 between the mast 2 and the fuselage 8 via the adapter 13. It is essential here for the present invention that comparatively large areas are created, via which a transmission of forces and torques that occur takes place, so that increased area loads and stresses in individual areas are ruled out.

While specific embodiments of the invention have been shown and described in detail to illustrate the application of the principles of the invention, it will be understood that the invention may be embodied otherwise without departing from such principles.

LIST OF REFERENCE NUMBERS

1 Hydrofoil
2 Mast
3 Incoming flow edge
4 Discharge edge
5 Lateral surface
6 Upper mast end
7 Holder
8 Fuselage
9 Lower mast end
10 Front wing
11 Rear wing
12 Screw connection
13 Adapter
14 Recess
15 Adapter outer surface
16 Adapter mount
17 Connection structure
18 Inner wall of the mast
19 Structural element
20 Bonded connection
21 Mast outer surface
22 Strut

What is claimed is:

1. A hydrofoil to be fastened to a watersports board, the hydrofoil comprising:

a mast comprising an incoming flow edge, a discharge edge, lateral surfaces connecting the incoming flow edge and a discharge edge, an upper mast end with a holder configured to be fastened at least indirectly to the watersports board, and a lower mast end;

a fuselage fastened to the lower mast end, the fuselage having a central longitudinal axis located at least nearly in a plane defined by the incoming flow edge and the discharge edge of the mast;

respective front and rear wings arranged on opposite sides of the mast at the fuselage, wherein the mast and the fuselage are configured as separate components and are connected to one another via a screw connection, the mast is configured as an extruded section and the fuselage has a recess; and an adapter arranged in the recess of the fuselage and connected to the mast and to the fuselage, wherein:

a positive locking is established between an adapter outer surface and the recess of the fuselage; and the adapter has an adapter mount into which the lower mast end is inserted, so that a positive locking is formed between the mast and the adapter such that the lower mast end is arranged within the fuselage.

2. A hydrofoil in accordance with claim 1, wherein a bonded connection is provided in at least some areas between the adapter and the mast, the lower mast end being in contact with the adapter.

3. A hydrofoil in accordance with claim 1, wherein the adapter comprises a connection structure, which protrudes into the mast and is in contact in at least some sections with an inner wall of the mast, wherein a portion of the adapter is located between the lower end of the mast and the fuselage.

4. A hydrofoil in accordance with claim 3, wherein a bonded connection is provided in at least some areas between the connection structure and the inner wall of the mast.

5. A hydrofoil in accordance with claim 1, wherein the adapter comprises a plastic, the lower end of the mast being located between one portion of the adapter and another portion of the adapter.

6. A hydrofoil in accordance with claim 5, wherein the plastic is reinforced with glass fibers and/or carbon fibers.

7. A hydrofoil in accordance with claim 5, wherein the adapter is manufactured by plastic injection molding.

8. A hydrofoil in accordance with claim 1, wherein the mast, the fuselage and/or the adapter comprise aluminum, manganese or carbon fibers, the lower end of the mast being located at a spaced location from the fuselage.

9. A hydrofoil in accordance with claim 1, wherein the mast, the fuselage and/or the adapter have a protective coating in at least some areas.

10. A hydrofoil in accordance with claim 9, wherein the protective coating is configured as an oxide coating prepared by anodic oxidation.

11. A hydrofoil in accordance with claim 3, wherein the connection structure comprises at least one cuboid and/or cubic structural element, which is in contact with the inner wall of the mast in at least some areas within the mast.

12. A hydrofoil in accordance with claim 3, wherein the connection structure has at least one circular cylindrical and/or oval cylindrical structural element, which is in contact with the inner wall of the mast in at least some areas within the mast.

13. A hydrofoil in accordance with claim 3, wherein the connection structure comprises at least two structural elements, which are arranged in a row and which are in contact each with the inner wall of the mast in at least some areas within the mast.

14. A hydrofoil in accordance with claim 1, wherein the screw connection comprises at least one flat head screw with internal hexagon and a complementary internal thread arranged in the mast, wherein a portion of the adapter extends beyond the lower end of the mast.

15. A hydrofoil in accordance with claim 1, wherein anti-seize paste is provided in the area of the screw connection.

16. A hydrofoil in accordance with claim 1, wherein an electrically non-conducting element and/or an electrically non-conducting layer is arranged between a screw of the screw connection and the fuselage.

17. A hydrofoil in accordance with claim 1, wherein the rear wing is bent upwards in at least some areas at both of ends about a surface thereof facing the mast, the mast being located at a spaced location from the fuselage.

18. A hydrofoil in accordance with claim 1, wherein a fin is arranged in the rear area of the fuselage.

19. A hydrofoil in accordance with claim 1, wherein a fin, integrated into the rear wing, is arranged in the rear area of the fuselage.

20. A hydrofoil in accordance with claim 18, wherein the fin is directed upwards and the fin projects beyond a surface of the fuselage, which surface of the fuselage faces the mast.

21. A watersports board for wakeboarding, surfing and/or kitesurfing, the watersports board comprising:

an underside; and a hydrofoil fastened on the underside, the hydrofoil comprising:

a mast comprising an incoming flow edge, a discharge edge, lateral surfaces connecting the incoming flow edge and a discharge edge, an upper mast end with a holder configured to be fastened at least indirectly to the watersports board, and a lower mast end;

a fuselage fastened to the lower mast end, the fuselage having a central longitudinal axis located at least nearly in a plane defined by the incoming flow edge and the discharge edge of the mast;

respective front and rear wings arranged on opposite sides of the mast at the fuselage, wherein the mast and the fuselage are configured as separate components and are connected to one another via a screw connection, the mast is configured as an extruded section and the fuselage has a recess; and an adapter arranged in the recess of the fuselage and connected to the mast and to the fuselage, wherein:

a positive locking is established between an adapter outer surface and the recess of the fuselage; and the adapter has an adapter mount into which the lower mast end is inserted, so that a positive locking is formed between the mast and the adapter such that the lower mast end is arranged within the fuselage.

* * * * *